United States Patent [19]

Frank

[11] Patent Number: 4,634,111

[45] Date of Patent: Jan. 6, 1987

[54] FRICTION SEPARATION DEVICE

[75] Inventor: Werner Frank, Reichenau, Fed. Rep. of Germany

[73] Assignee: Licentia Patent-Verwaltungs-GmbH, Frankfurt am Main, Fed. Rep. of Germany

[21] Appl. No.: 692,882

[22] PCT Filed: May 15, 1984

[86] PCT No.: PCT/EP84/00144

§ 371 Date: Jan. 15, 1985

§ 102(e) Date: Jan. 15, 1985

[87] PCT Pub. No.: WO84/04517

PCT Pub. Date: Nov. 22, 1984

[30] Foreign Application Priority Data

May 17, 1983 [DE] Fed. Rep. of Germany ..... 3317863

[51] Int. Cl.[4] ..... B65H 3/04

[52] U.S. Cl. ..... 271/34; 271/148; 271/150

[58] Field of Search ..... 271/34, 148, 171, 160, 271/149, 150

[56] References Cited

U.S. PATENT DOCUMENTS

| | | | |
|---|---|---|---|
| 3,952,183 | 4/1976 | Abe | 271/149 X |
| 4,219,192 | 8/1980 | Burke | 271/127 X |
| 4,302,000 | 11/1981 | Frank | 271/148 |
| 4,405,122 | 9/1983 | Faltin | 271/149 X |

FOREIGN PATENT DOCUMENTS

| | | | |
|---|---|---|---|
| 419574 | 10/1925 | Fed. Rep. of Germany | 271/160 |
| 2354107 | 5/1975 | Fed. Rep. of Germany . | |
| 2613261 | 9/1978 | Fed. Rep. of Germany . | |
| 2736337 | 2/1979 | Fed. Rep. of Germany . | |
| 2712907 | 5/1980 | Fed. Rep. of Germany . | |
| 2378706 | 2/1978 | France . | |
| 37500 | 3/1977 | Japan | 271/160 |
| 48342 | 5/1981 | Japan | 271/34 |

OTHER PUBLICATIONS

IBM Technical Disclosure Bulletin, vol. 19, No. 2, published Jul. 1976.

*Primary Examiner*—Richard A. Schacher
*Attorney, Agent, or Firm*—Spencer & Frank

[57] ABSTRACT

A friction separator for separating letters and similar flat items from a stack of such items. The friction separator comprises a base belt for supporting the stack of items and conveying them in a first direction, a guide wall extending along one side of the belt and a removal member for withdrawing the foremost items in the stack through a gap between the guide wall and the removal member. A first support member is positioned in a plane defined by the leading edge of the stack at the trailing portion of the shortest item withdrawn by the removal member, the first support member supporting the stack at a point spaced from the guide wall by a distance which is less than the length of the shortest item to be processed. A second support member is positioned at a location between the plane and the trailing edge of the stack of items supported by the belt, and is further positioned at a distance from the guide wall which is less than the length of the longest item to be processed. Means are provided for resiliently pressing at least one of the first and second support members against the stack.

17 Claims, 6 Drawing Figures

FRICTION SEPARATION DEVICE

FRICTION SEPARATOR

Background of the Invention

The invention relates to a friction separator. Such a friction separator is known, for example, from German Pat. No. 2,736,337. Other comparable prior art is disclosed in German laid-open application No. 2,354,107, and German Pat. Nos. 2,613,261 and 2,712,907.

It is the object of the invention to provide a friction separator for letters of all types up to a given size and thickness so as to improve the state of the art to the effect that the removal device operates with less susceptibility to malfunction even with pieces of mail of uneven thickness.

SUMMARY OF THE INVENTION

The present invention comprises a friction separator for separating letters and similar flat items from a stack of such items. It comprises a base belt for supporting the stack of items and conveying them in a first direction, a guide wall extending along one side of the belt and a removal member for withdrawing the foremost items in the stack through a gap between the guide wall and the removal member. A first support member is positioned in a plane defined by the leading edge of the stack at the trailing portion of the shortest item withdrawn by the removal member, the first support member supporting the stack at a point spaced from the guide wall by a distance which is less than the length of the shortest item to be processed. A second support member is positioned at a location between the plane and the trailing edge of the stack of items supported by the belt, and is further positioned at a distance from the guide wall which is less than the length of the longest item to be processed. Means are provided for resiliently pressing at least one of the first and second support members against the stack.

Separation of mail can be effected advantageously and without malfunctions even if these pieces of mail have differences in thickness of several millimeters between their upper and lower longitudinal edges and, when seen in the direction of advance of the piece of mail, between its front and rear transverse edges. In the separation process, pieces of mail which are thicker at their rear transverse edges than at their front transverse edges are particularly critical because in these pieces of mail, the stack pressure builds up between the supporting rollers and the stack and not—as needed for proper operation—between the stack and the removal belts, so that the friction force drops between the pieces of mail and the removal belts with the result that the slip produced thereby increases the size of the gaps between the pieces of mail and, consequently, the removal rate is reduced. In extreme cases, no pieces of mail are removed at all so that the removal device is blocked.

DESCRIPTION OF THE PREFERRED EMBODIMENTS

In FIGS. 1-6, 1 designates a removal rocker, 2 a stripper, 3 a continuously running conveyor belt, 4 the abutment edge of a stack of mail 8, 5 a resilient support roller I, 6 a resilient support roller II, 7 a base belt, 9 a pair of tension springs, 10 a pair of microswitches $S_2$ and $S_3$, 11 an eccentric adjusting disc, 12 a tension spring, 13 a resilient rocker and roller, 14 a tension spring, 16 an adjustable base, 17 a base plate, 19 a drive motor with gears, 20 a circular belt, 21 a roller, 22 a free wheeling mechanism and 23 a suspension.

Figure 2:
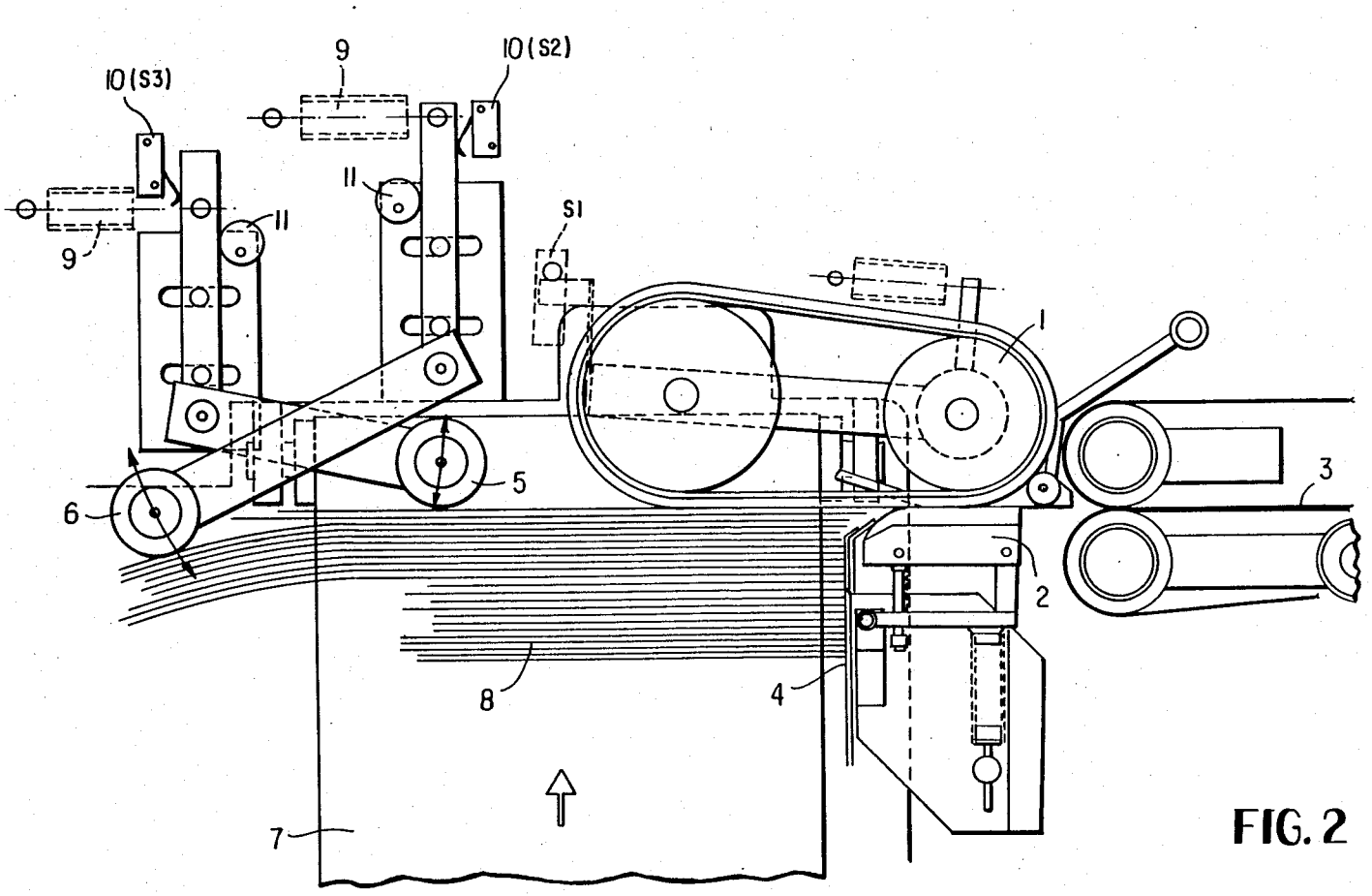
FIG. 2 is a plan view of a friction separator showing one embodiment of the present invention.
Figure 3:
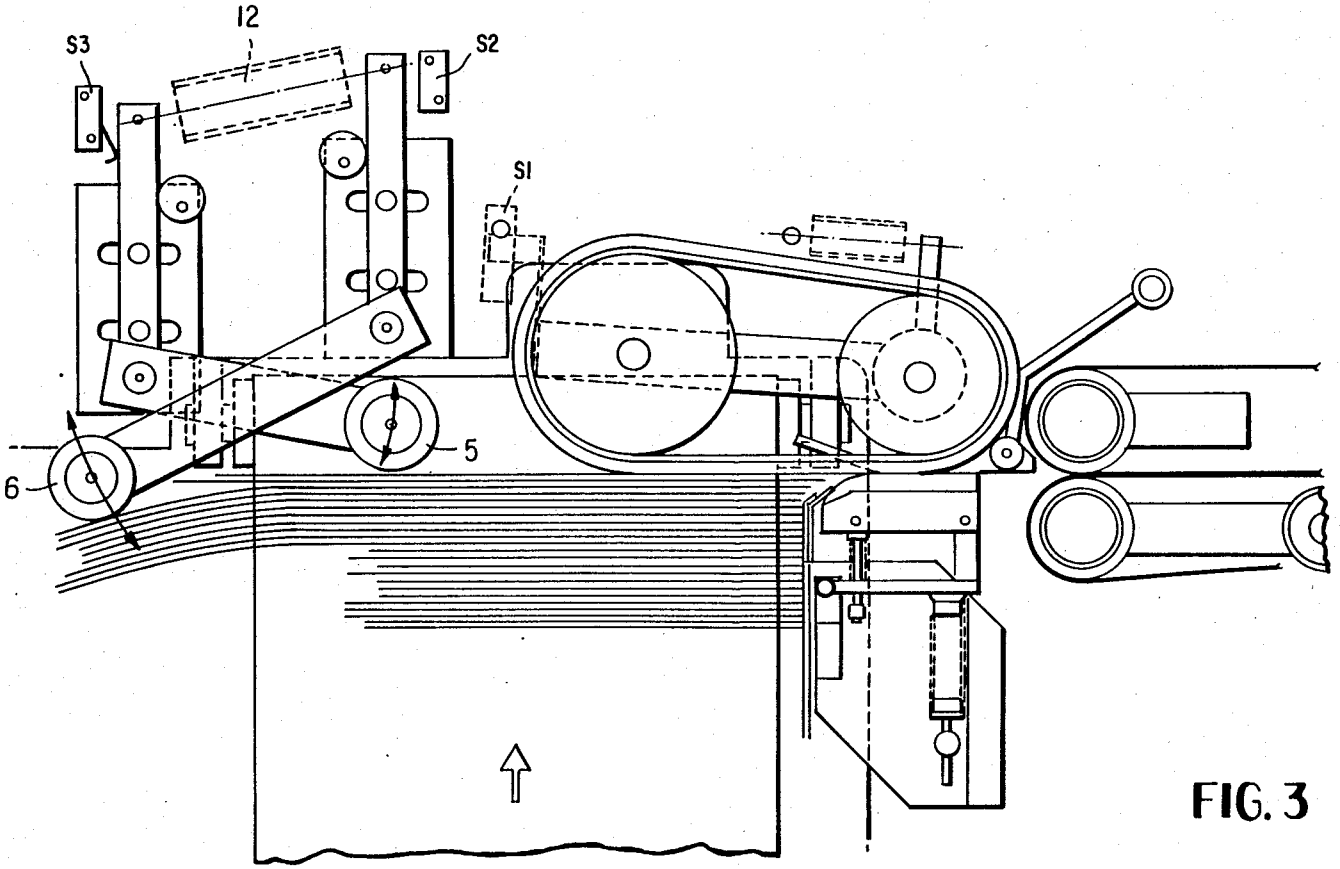
FIG. 3 is a plan view of a friction separator showing a second embodiment of the invention.

The basic structure of the friction separator according to FIG. 2 essentially correponds, except for its additions which are significant to the invention, to that shown in the drawing of German Pat. No. 2,736,337. A significant inventive feature of the friction separator according to FIG. 2 is that at least one of the supporting members, for example support roller 5, is placed resiliently against stack 8. Preferably, the second supporting member, in the illustrated example supporting roller 6, is also placed resiliently against this stack. For this purpose, the illustrated rockers are provided which, in principle, may be equipped with separate contact springs 9 which preferably, however,—as shown in FIG. 3—are connected to a common spring 12 by means of a parallelogram structure that is adjustable by means of eccentrics 11.

The advance of the base belt 7 is advisably controlled by way of switches S2 and S3 in parallel with switch S1 of the removal rail.

Figure 4:
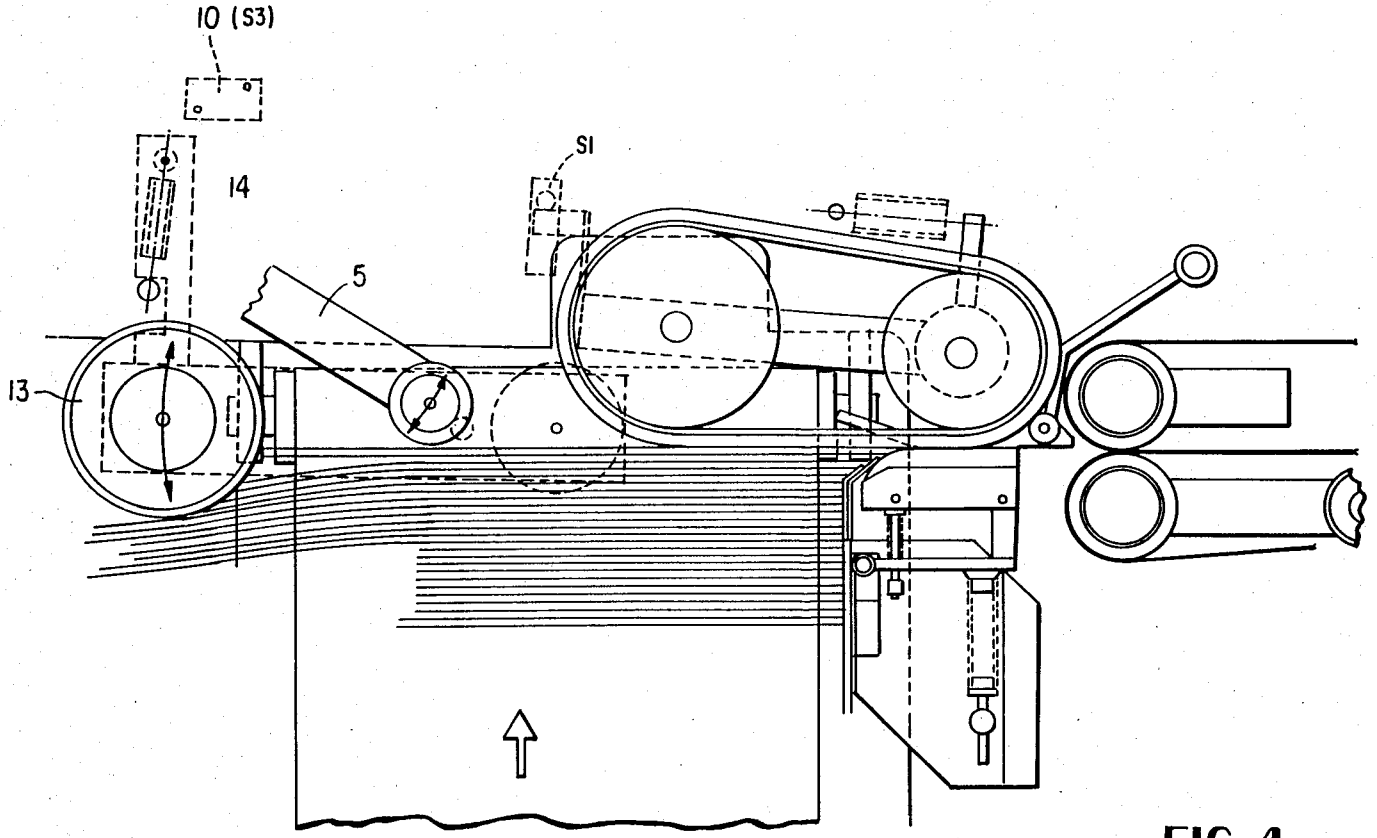
FIG. 4 is a plan view showing a third embodiment of the invention.
Figure 5:
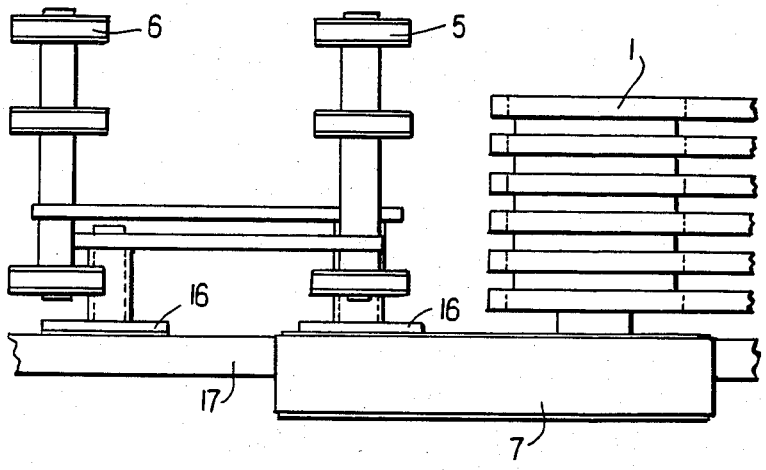
FIG. 5 is a sectional view of the embodiments of the invention shown in FIGS. 2 and 3.
Figure 6:
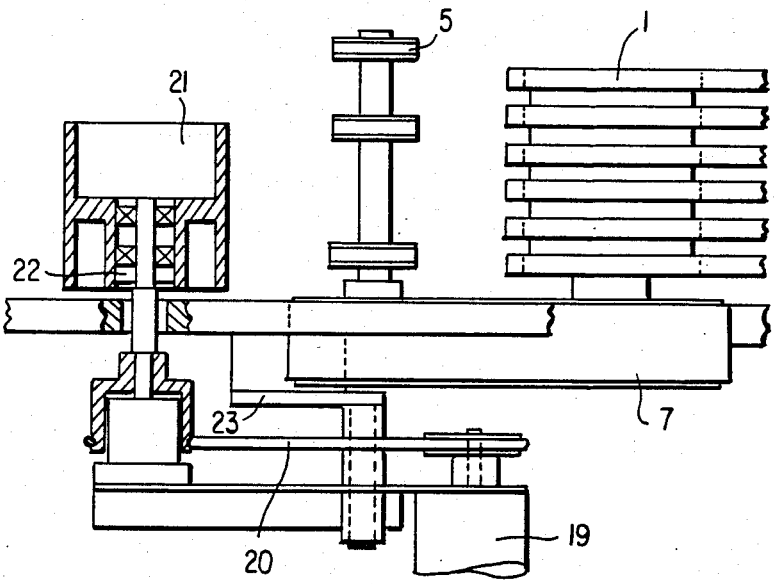
FIG. 6 is a sectional view of the embodiment shown in FIG. 4.

It is of particular advantage if, as a further feature of the invention, the second supporting member—in the embodiment of the invention shown in FIG. 4, roller 13—is itself driven in the direction of removal of the mail items, for example by its own, i.e. a separate, motor or by being mechanically coupled with the drive of removal member 1. If, in this embodiment of the invention shown in FIG. 4, irregularly filled pieces of mail, whose rear transverse edges are thicker than their front transverse edges, are pressed against the support roller, roller 13 pushes this piece of mail in the removal direction and thus prevents the above-mentioned damaging slip since the gaps between successive pieces of mail would otherwise become larger or the removal device could even be blocked. The support roller presses resiliently against the stack and, with increasing stack pressure, it escapes so that the stack pressure remains constant.

It is very advisable to equip driven roller 13 with an overrunning clutch 22 (FIG. 6), which, when the removal belts take over a respective piece of mail, permits adaptation of the rotation of roller 13 to the removal speed.

Figure 1:
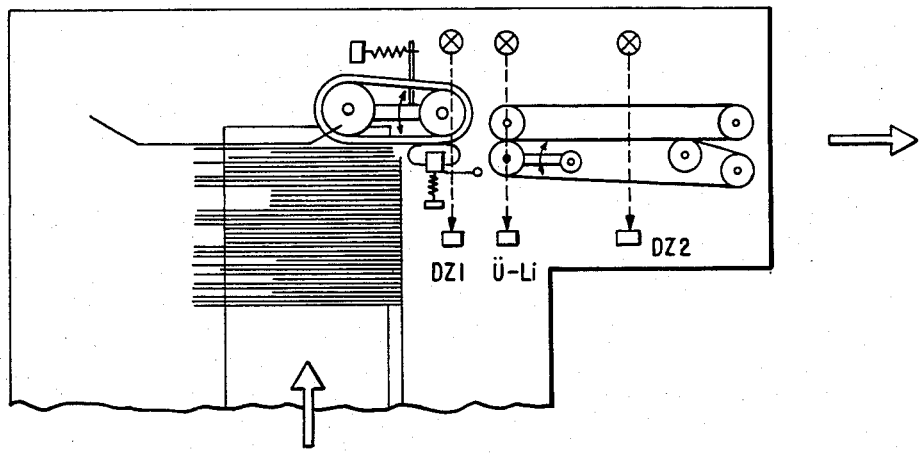
FIG. 1 is a simplified top plan view of a friction separator.

FIG. 1 is an overview of a friction separator and its features which are advisable for the invention. It essentially comprises a plurality of parallel moving, superposed removal belts, mechanical strippers and a control mechanism.

The removal belts are covered with a material that has a high coefficient of friction.

The guide roller adjacent the stack of letters and common to all removal belts is mounted on a rocker; the axis of the drive roller, which is likewise common to all removal belts, forms the pivot of this rocker.

The rocker simultaneously controls the advance of the base belt which brings the stack of mail to the removal device.

The mechanical strippers are arranged at such a height that they grip between the removal belts, i.e. do not come into contact with the removal belts. This prevents wear if no letter is in front of the strippers while the removal belts are running.

A short piece of conveying path is connected to the outlet of the removal device. An intake roller of this conveying path is mounted on a rocker and resiliently placed against a counterroller so as to assure that pieces of mail of varying thickness are securely carried along.

Light barriers are provided in the region of the outlet of the removal device and the intake of the conveying path and are broken by passing pieces of mail. The light barrier signals are fed to a control circuit which starts and stops the removal belts in such a manner that the desired gaps between the pieces of mail are created during removal. This gap can be set by way of the distance DZ1–DZ2.

With the special arrangement of the light barriers and the design of the control mechanism, stacking inaccuracies (offset leading edges in the stack) are compensated during removal. Thus, the resulting gap tolerance is particularly close.

I claim:

1. A friction separator for separating letters and similar flat items from a stack of such items, the length of each of said items being between a predetermined minimum length and a predetermined maximum length, comprising a base belt for supporting said stack of items and conveying them in a first direction, the leading edge of said stack of items defining a plane perpendicular to said first direction;

a guide wall extending along one side of said belt;

a removal member mounted for frictional engagement with the foremost item in said stack, said removal member withdrawing said foremost item through a gap between said guide wall and said removal member in a second direction parallel to the plane defined by the leading edge of said stack;

a first support member positioned in the plane defined by the leading edge of said stack at the trailing portion of the shortest item withdrawn by said removal member, said first support member supporting said stack at a point spaced from said guide wall by a distance which is less than said predetermined minimum length;

a second support member positioned at a location between said plane and the trailing edge of the stack of items supported by said base belt, said second support member being further positioned at a distance from said guide wall which is less than said maximum length and greater than said minimum length for supporting the longest items withdrawn by said removal member; and means for resiliently pressing at least one of said first and second support members against said stack.

2. A friction separator according to claim 1, wherein said second support member is provided with at least one roller driven in said second direction and resiliently pressed against said stack.

3. A friction separator according to claim 2, which further comprises a rocker member for pressing said at least one roller resiliently against said stack.

4. A friction separator according to claim 3, which further comprises drive means for rotating the at least one roller of said second support member.

5. A friction separator according to claim 3, wherein at least one of said driven rollers is equipped with an overrunning clutch.

6. A friction separator according to claim 2, which further comprises drive means for rotating the at least one roller of said second support member.

7. A friction separator according to claim 6, wherein at least one of said driven rollers is equipped with an overrunning clutch.

8. A friction separator according to claim 6, wherein said drive means is a separate motor.

9. A friction separator according to claim 6, wherein said drive means comprises a mechanical coupling to said removal member.

10. A friction separator according to claim 2, wherein at least one of said driven rollers is equipped with an overrunning clutch.

11. A friction separator according to claim 1 wherein said first and second support members are resiliently pressed against said stack by first and second springs respectively.

12. A friction separator according to claim 1 wherein said first and second support members are resiliently pressed against said stack by a common spring.

13. A friction separator according to claim 12, which further comprises rocker members coupled to said common spring, a parallelogram structure coupled to said rocker members and eccentric means for adjusting said parallelogram structure, whereby said rocker members, spring, parallelogram structure and eccentric means cooperate to press said first and second support members against said stack.

14. A friction separator according to claim 1, wherein said removal member includes first and second rollers, at least one removal belt connecting said first and second rollers, and a movable rocker coupled to said second rollers, whereby acceleration of said removal belt results in increased pressure being exerted on the item being removed.

15. A friction separator according to claim 14, which includes at least two removal belts, and which further comprises a stripper located for gripping said items between said removal belts without coming into contact therewith.

16. A friction separator according to claim 15, which further includes resetting levers for supporting said strippers when no item is present to be withdrawn, the positions of said resetting levers being automatically set in accordance with the thickness of said removal belts.

17. A friction separator according to claim 14, which further comprises means for driving said base belt; and a sensor for determining the immersion depth of said movable rocker, said sensor energizing said means for driving said base belt when said immersion depth exceeds a predetermined limit.

* * * * *